United States Patent [19]

Marzonie et al.

[11] 4,019,023

[45] Apr. 19, 1977

[54] ELECTRICALLY HEATED DRYER

[75] Inventors: James M. Marzonie, Hancock; Karl Jautakis, Sawyer, both of Mich.

[73] Assignee: Whirlpool Corporation, Benton Harbor, Mich.

[22] Filed: June 16, 1975

[21] Appl. No.: 587,437

[52] U.S. Cl. ..... 219/400; 34/133; 165/123; 219/367; 219/368; 219/374; 338/206; 338/280

[51] Int. Cl.[2] ..... F26B 11/00; H05B 3/12; F24H 3/04

[58] Field of Search ..... 219/366–370, 219/374–376, 381, 382, 400; 338/206, 208, 53–58, 279–292; 34/132–134, 133; 165/123

[56] References Cited

UNITED STATES PATENTS

| | | | |
|---|---|---|---|
| 771,908 | 10/1904 | Heath | 219/367 UX |
| 992,728 | 5/1911 | McElroy | 219/368 |
| 1,878,012 | 9/1932 | Stacy et al. | 165/123 |
| 2,501,812 | 3/1950 | Fodor | 126/67 |
| 2,827,276 | 3/1958 | Racheter | 34/133 X |
| 3,651,304 | 3/1972 | Fedor | 219/375 X |
| 3,898,426 | 8/1975 | Maake | 219/375 X |

FOREIGN PATENTS OR APPLICATIONS

| | | | |
|---|---|---|---|
| 569,228 | 1/1924 | France | 219/376 |
| 931,179 | 9/1947 | France | 338/206 |
| 489,782 | 8/1938 | United Kingdom | 219/375 |
| 876,541 | 9/1961 | United Kingdom | 219/367 |

*Primary Examiner*—A. Bartis
*Attorney, Agent, or Firm*—Wegner, Stellman, McCord, Wiles & Wood

[57] ABSTRACT

A dryer for articles such as a clothes dryer having a container for the articles and an air duct leading to the container for directing an air stream into the container for contact with the articles therein. Located in the duct is a heater for heating the air stream before it enters the container and an air mixing baffle in the duct extending at an angle in the direction of the air stream flow and partially into the stream for creating an even temperature turbulence in the air stream and to break up any hot air stratification. The duct is provided with an air inlet opening for supplying ambient air that mixes with the heated air as a result of the turbulence created by the mixing baffle thereby forming an even, reduced temperature of the air stream. The ambient air opening is located generally along the flow path between the baffle and the outlet from the duct. The baffle and ambient air inlet are located downstream of the heater and the baffle is downstream of the heater and upstream of the ambient air inlet and outlet from duct.

11 Claims, 3 Drawing Figures

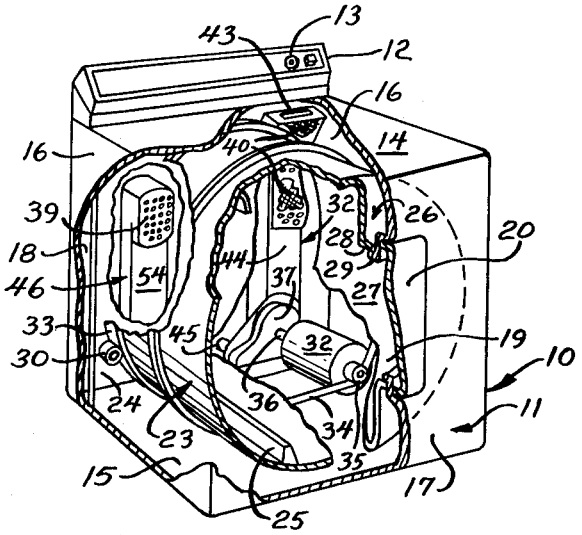
Fig. 1
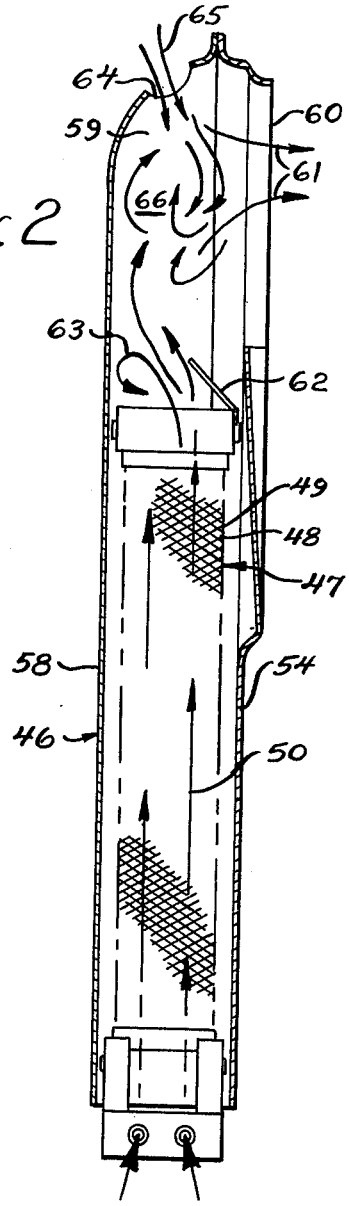
Fig. 2
Fig. 3
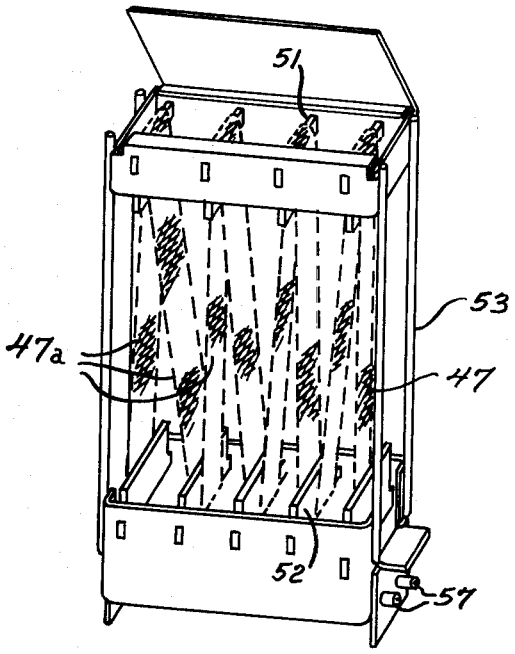

ELECTRICALLY HEATED DRYER

BACKGROUND OF THE INVENTION

This invention relates to a dryer such as a clothes dryer for articles which are held in a container during the drying and provides a heating means in the air duct to the container and an air mixing baffle in the duct in combination with an ambient air inlet opening so that the cooler ambient air will be mixed with the heated air from the heater to provide a uniform temperature throughout the flowing air stream and to reduce the temperature thereof before directing the air into the drying container.

The invention is particularly important for dryers using electric heating means and particularly an electric heater having an expanded metal resistance unit because under such conditions the heated air tends to stratify in streamline flow with the various strata having different temperatures which tends to cause hot spots or overheated areas in the duct particularly at the region of the entrance to the drying container. The dryer of this invention successfully prevents this.

The most pertinent prior art of which applicants are aware is as follows: U.S. Pat. Nos. 3,651,304; 3,798,417 and 3,860,789. These patents disclose electric resistance heating elements of the expanded metal type. However, none of these patents discloses the combination of this invention as claimed in the appended claims.

U.S. Pat. No. 1,579,852; 1,996,253 and 2,422,825 each disclose a dryer having heating means and means for mixing the heated air with ambient air. U.S. Pat. No. 2,635,354 discloses a baffle for directing ambient air into a stream for mixing with the heated air before the mixture enters the dryer container. U.S. Pat. No. 2,827,276 discloses a dryer with a heater contained in a heater box which is supplied with ambient air through an opening in an upper portion of the box together with a baffle for deflecting the heated air into the dryer container. U.S. Pat. No. 3,290,028 discloses a dryer where the hot air from a gas burner is mixed with ambient air in a cooling zone and the mixture then directed into the dryer container.

Although the above prior patents are the most pertinent of which applicants are aware, none discloses a combination including a baffle within a heater box immediately downstream from a heating means adjacent the side of the heater box that is nearest the dryer container and thus subjected to the heat in the container for creating turbulence of the air in a zone between the downstream end of the heating means or heater and the inlet opening to the dryer container with air opening for ambient air in the heater box adjacent the inlet to the dryer container.

As stated above, the invention is particularly important with an expanded metal heating element of the type disclosed and claimed in our copending application Ser. No. 587,436, filed June 16, 1975 assigned to the same assignee as the present application.

The combination of this invention is also particularly adaptable to a compact heater unit in which the heating means, baffle, ambient air inlet and air entrance opening to the dryer container is a compact self-contained unit that forms an air duct for inlet air to the drum of a dryer.

SUMMARY OF THE INVENTION

This invention therefore is directed essentially to a dryer that comprises an improved structure for heating the air uniformly across a flowing stream of air and having a heating means, a turbulence inducing baffle downstream of the heating means, and an inlet opening for ambient air downstream of the baffle and adjacent to the inlet from the heated air duct to the dryer container. Although the invention has proved particularly advantageous when used in conjunction with heater elements of the expanded metal type, the invention is not so limited and may also be used in conjunction with more conventional heater elements of other types.

BRIEF DESCRIPTION OF THE DRAWINGS

FIG. 1 is a perspective view partially in section and partially broken away of the clothes dryer of the invention.

FIG. 2 is an enlarged longitudinal view of a heater box embodying the invention.

FIG. 3 is a perspective view of the resistance element and air mixing baffle of the unit of FIG. 2.

DESCRIPTION OF THE PREFERRED EMBODIMENT

In the embodiment illustrated in the drawings the clothes dryer apparatus 10 comprises an enclosing cabinet 11 having a control console 12 of the usual type that houses a control device settable by a control knob 13 for regulating the drying operation of the dryer 10, as for example either automatic or timed drying cycles.

The cabinet 11 comprises a generally horizontal panel 14, a horizontal bottom panel 15, a pair of side panels 16, a vertical front panel 17 and a vertical rear panel 18. The cabinet also includes an access opening 19 in the front panel 17 having a closure door 20 of the customary type cooperating with the opening for loading and unloading the dryer 10.

The dryer 10 further includes a drying container for tumbling the clothes during the drying thereof in the form of a rotatable drum 23 housed within the cabinet 11 and extending axially from approximately the front panel 17 to a bulkhead 24 that is spaced forwardly of the rear panel 18. To develop tumbling action in the drum 23 of the clothes being dried therein there are provided a plurality of circumferentially spaced baffles 25 extending generally radially of the inner surface of the drum 23. The drum includes a radially inwardly-extending front closure wall 26 having an access opening 27 therein formed by an outturned flange 28 that extends essentially axially. This flange 28 provides a forward-extending bearing annulus which overlies and is suitably journaled on the complemental flange 29 of the cabinet 11.

The drum 23 is supported at the rear by a pair of support rollers 30 of which only one is shown in FIG. 1. These are horizontally aligned on opposite sides of the drum and are mounted on the bulkhead 24. A raceway or centrifugal groove 33 is provided in the drum to serve as a track for the supporting rollers 30.

In order to rotate the drum 23 there is provided a motor 32 mounted on the bottom panel 15 at a rear corner of the cabinet. The drum is driven by a drive belt 34 that extends around the periphery of and in frictional engagement with the drum and around a motor driven pulley 35. The pulley 35 is mounted on the front end of the horizontal motor shaft 36 while the other or rear end of this shaft drives a blower 37 arranged to circulte air through the drum 33 in the customary manner. This blower 37 is included in a warm air system 38 that is located between the rear panel 18 and the bulkhead 24.

The bulkhead 24 serves to enclose the open ended rear portion of the drum 23 and provides a fixed rear wall in which is located a pair of spaced openings comprising an air inlet 39 and an air outlet 40.

The blower 37 draws moisture laden air from the interior of the drum 23 through the outlet 40, through a removable lint screen 43 and an air duct 44 downwardly to the blower 37 and out of the cabinet 11 through an exhaust duct 45.

Air exhausted in this manner from the drum 23 is replaced by ambient air entering the warm air system 38 by way of an intake opening (not shown) in the rear panel 18. This fresh air is drawn through a fresh air duct 46 where it is heated and then flows into the drum 23 through the air inlet 39. The warm air system 38 thus circulates a stream of warm air through the drum 23 subjecting clothes placed therein to a drying environment during the tumbling caused by the rotation of the drum and the baffles 25 to remove moisture from the clothes.

The heater means may be in the form of an expanded metal resistance element 47 which may be of the same type disclosed in detail in our above copending application. This expanded metal heating element has strands 48 and interconnecting bridges 49 with the strands of each reach 47a being at an angle to the plane of that reach of the resistance element 47 and the strands being separated by openings through which the air flow 50 passes.

In the embodiment illustrated the resistance element 47 is in one continuous sheet comprised of a plurality of somewhat zig-zag reaches 47a supported on top and bottom by spaced insulated supports 51 and 52 in an open frame 53 having a front wall 54 of the heater box 46 facing the dryer container or drum 23. This frame is provided on the bottom with the terminal connections 57 for providing electrical energization of the resistance element 47.

The fresh air duct or heater box 46 in addition to the front wall 54 also comprises a rear wall 58 spaced therefrom and opposite side walls 59. At the top of the front wall 54 (in the end portion 66 of the air duct) is an air entrance or inlet opening 60 for supplying air to the interior of the drum 23. Thus the heated air through the heater box 46 flows vertically upwardly as indicated at 50 in FIG. 2 and then generally at a right angle laterally as shown by the arrows 61.

Because the heated air tends to stratify particularly where the heating element comprises an expanded metal resistance element as shown, a mixing baffle 62 is provided. This baffle as shown in FIG. 2 is adjacent the front wall 54 and extends at an angle in the direction of the air stream 50 flow which, in the embodiment of FIG. 2, is generally upwardly and toward the opposite or rear wall 58. In the illustrated embodiment this baffle, which is mounted adjacent the front wall 54, extends upwardly at an angle of about 45° to the vertical or the direction of air flow 50. This baffle breaks up the stratified layers of different temperature and mixes them thoroughly as indicated by the flow arrows 63.

In addition, there is provided an ambient air inlet opening 64 in the duct or heater box 46 generally in the air flow path between the baffle 62 and the air entrance opening 60. In the illustrated embodiment this ambient air opening 64 is adjacent to the inlet opening 60 at the top of the heater box 46. The ambient air 65 is drawn through the opening 64 as illustrated and is mixed with heated air in the upper portion 66 of the heater box principally as a result of the turbulence created by the baffle 62. The baffle 62 therefore creates turbulence in the air flow so as to avoid layers of upwardly flowing air of different temperature which is a particular problem with heating elements of expanded metal as disclosed, and also facilitates a thorough mixing of this heated air with ambient air in the upper end portion 66 of the heater box so that the mixture of conditioned air 61 directed into the dryer drum 23 is uniform in temperature and not excessively hot. This mixing results from the baffle 62 directing heated air from the heater towards the ambient air opening 64 in the rear wall of the duct and creating a turbulence within the upper portion 66 (between the baffle and the top of the duct) of the air duct. In a typical embodiment where the heater box was about 5¾ inches wide and 3¼ inches thick and 23½ inches long the air inlet opening 64 was circular and about 1 inch in diameter. The area of the opening 64 was between 0.86 and 0.70 square inches.

It has been found that for a particular dryer an expanded metal heater using approximately 5200 watts was able to provide an acceptable drying time whereas for the same dryer a conventional heater required 5600 watts to provide the same drying time. It has also been found that use of a 5200 watt expanded metal heater in the particular dryer tested may result in unacceptably high air inlet temperatures to the dryer drum which creates a danger of clothes damage. By adding the baffle in accordance with this invention to mix air downstream of the heater element with ambient air before introduction to the dryer drum these excessively high inlet temperatures were avoided without reducing the quantity of heat added to the dryer drum and, therefore, without adversely affecting the drying time of the machine. The optimum placement for the baffle used in this particular dryer with a particular expanded metal heater was found to be adjacent the upstream end of the heater as shown in FIG. 3.

The embodiment of the invention in which an exclusive property or privelege is claimed is defined as follows:

1. A dryer for articles, comprising: a drying container for the articles; an air duct leading to said container having an air entrance opening to said container, a front wall facing said container and a rear wall; means for directing an air stream through said duct; heating means in said duct spaced from said entrance for heating said air stream; an air mixing baffle means in said duct upstream of said air entrance opening and downstream of said heating means and adjacent said front wall and extending at an angle in the direction of said air stream and inwardly of said duct and toward said rear wall and said entrance for creating an even temperature turbulence in said air stream thereby tending to eliminate any hot air stratification; an ambient air inlet opening means to said duct between said baffle and said air entrance opening and downstream of said heating means, and said baffle means said baffle means being located downstream of said heating means and upstream of said ambient air inlet.

2. The dryer of claim 1 wherein said air duct comprises a heater box including said air opening, said front and rear walls, said heating means and said baffle.

3. The dryer of claim 2 wherein said heater box is elongated, said air entrance opening is located at one end thereof in said front wall and said ambient air inlet means is located adjacent to said one end.

4. The dryer of claim 1 wherein said heating means comprises an electric resistance heating element in said duct comprising an expanded resistance metal element.

5. The dryer of claim 4 wherein said metal element comprises a continuous sheet in a plurality of reaches spaced from each other across said duct.

6. The dryer of claim 4 wherein said heater box is elongated and said expanded resistance metal element substantially spans the internal dimensions of said duct.

7. The dryer of claim 6 wherein said metal element is in one continuous strip arranged in reaches each at an angle to the next adjacent reach.

8. A clothes dryer, comprising: a drying container for clothes; an air duct including front and rear wall means, said front wall means defining an air entrance opening to said container in an end portion of said air duct, said rear wall means defining an ambient air inlet opening in said end portion of said air duct through which ambient air enters said duct; means for drawing air through said air duct and through said air entrance opening into said drying container; heater means in said air duct adjacent said end portion for heating air passing thereover; and air mixing baffle means in said duct between said end portion of said duct and said heater means and located downstream of said heater means and upstream of said air entrance opening for mixing heated air from the heater means and directing said heated air toward the rear wall means in the end portion of said duct to promote mixing of said heated air with ambient air from the ambient air opening thereby tending to eliminate any hot air stratification, said baffle being mounted adjacent said front wall and extending at an angle in the direction of said end portion and inwardly of said duct toward said rear wall means, whereby conditioned air of appropriate and uniform temperature is provided to the container through said entrance opening, said ambient air inlet being located downstream of said heater means and baffle means, said baffle means being located downstream of said heater means and upstream of said ambient air inlet.

9. The dryer as claimed in claim 8 wherein the heater means includes an expanded metal electrical resistance element.

10. A clothes dryer, comprising: a drying container for clothes; an air duct including front and rear wall means, said front wall means defining an air entrance opening to said container in an end portion of said air duct, said rear wall means defining an ambient air inlet opening in said end portion of said air duct through which ambient air enters said duct; means for drawing air through said air duct and through said air entrance opening into said drying container; heater means in said air duct adjacent said end portion for heating air passing thereover; an air mixing baffle means in said duct between said end portion of said duct and said heater means and located downstream of said heater means and upstream of said air entrance opening for mixing heated air from said heater means and creating a turbulence of air within said end portion of said duct to mix ambient air with said heated air thereby tending to eliminate any hot air stratification of said heated air, said baffle being mounted adjacent said front wall and extending at an angle in the direction of said end portion and inwardly of said duct toward said rear wall means, whereby conditioned air of appropriate and uniform temperature is provided to the container through said entrance opening, said ambient air inlet being located downstream of said heater means and baffle means, said baffle means being located downstream of said heater means and upstream said ambient air inlet.

11. The dryer as claimed in claim 10 wherein the heater means includes an expanded metal electrical resistance element.

* * * * *